United States Patent [19]

Howsley

[11] Patent Number: 4,765,771

[45] Date of Patent: Aug. 23, 1988

[54] APPARATUS FOR INSERTING SEALING STRIP INTO CONCRETE EXPANSION JOINTS

[75] Inventor: Michael J. Howsley, Weatherford, Tex.

[73] Assignee: JMK International, Inc., Fort Worth, Tex.

[21] Appl. No.: 50,723

[22] Filed: May 15, 1987

[51] Int. Cl.[4] ..... E01C 11/02; E01C 23/09

[52] U.S. Cl. ..... 404/74; 404/87; 52/743; 29/235; 74/200; 180/53.61

[58] Field of Search ..... 404/73, 74, 87; 52/741, 52/743, 744; 29/235, 451; 74/194, 200, 201; 180/53.61

[56] References Cited

U.S. PATENT DOCUMENTS

| | | | |
|---|---|---|---|
| 693,290 | 2/1902 | Lucas | 74/194 |
| 1,165,353 | 12/1915 | Woodworth | 74/200 |
| 1,814,165 | 7/1931 | Jacobsen | 74/200 |
| 2,527,203 | 10/1950 | Tippen | 74/194 |
| 2,770,976 | 11/1956 | Frantz et al. | 74/194 |
| 3,364,828 | 1/1968 | Shope et al. | 404/87 |
| 3,368,465 | 2/1968 | Tonjes | 404/87 |
| 3,422,734 | 1/1969 | Tonjes et al. | 404/87 |

*Primary Examiner*—Stephen J. Novosad
*Assistant Examiner*—John F. Letchford
*Attorney, Agent, or Firm*—James E. Bradley

[57] ABSTRACT

A machine to insert strips in expansion joints and concrete surfaces has features to prevent placing the strip in the joint while stretched. The machine includes the frame mounted on wheels. A supply reel mounted to the frame has a quantity of the strip wound about it. An insertion disk is rotatably mounted to the frame and positioned in the groove to push the strip into the groove. A pair of driven pinch rollers pull the strip from the roller. The drive mechanism for the rollers rotates the rollers at a speed selected to eliminate any tension in the strip between the insertion disk and pinch rollers.

10 Claims, 2 Drawing Sheets

APPARATUS FOR INSERTING SEALING STRIP INTO CONCRETE EXPANSION JOINTS

BACKGROUND OF THE INVENTION

1. Field of the Invention

This invention relates in general to equipment for inserting a resilient sealing strip into a groove in a concrete surface, and in particular to a machine that draws a supply of the strip from a reel.

2. Description of the Prior Art

Grooves are formed in concrete surfaces, such as airports or highways, at regular intervals. These grooves allow for expansion and contraction of the concrete with the seasonal temperature changes. To avoid deterioration, the grooves need to be sealed from water. Strips of resilient material of various types are forced into the groove to provide the sealant.

Machines have been used for inserting the strip into the groove. These machines have a reel mounted to a frame that is rolled on wheels. An insertion disk presses the strip into the groove. The strip is normally a compression type seal made of a rubber material such as neoprene.

In U.S. Pat. No. 4,699,540, issued Oct. 13, 1987, Robert M. Gibbon, a silicone rubber tube is used as a sealing strip. This tube is sealed in the groove by a liquid room temperature vulcanizing (RTV) sealing material. One difficulty in laying the silicone rubber tube is that it has a somewhat tacky surface when located on the supply reel. As the tube is pulled from the supply reel, it stretches. If the tube is pushed into the groove under a stretched condition, it will later begin to shrink back to its original length. This would result in it being too short. The prior art neoprene strips are much stiffer and do not stretch as much under the same conditions.

U.S. Pat. No. 3,364,828, L. L. Shope et al, shows a machine for inserting a compression type sealing strip into a groove. This machine has pinch rollers 41, 42 which are driven at the speed that is fixed relative to the speed of the wheels. The speed is selected to draw the strip off at the same rate that the machine moves over the ground.

SUMMARY OF THE INVENTION

The apparatus for installing the strip in the groove has features for preventing the strip from being installed while in a stretched condition. The apparatus has a frame mounted on wheels. A supply reel is mounted to the frame. An insertion disk is rotatably mounted to the frame and is adapted to push the strip drawn from the reel into the groove.

A pair of pinch rollers are rotatably mounted to the frame for tightly receiving the strip between them before the strip reaches the insertion disk. A drive means will rotate the pinch rollers to pull the strip from the reel with the pinch rollers. The speed that the pinch rollers rotate may be varied relative to the speed of the machine movement to remove tension between the pinch rollers and the insertion disk. Preferably, the speed at which the strip is drawn off is slightly greater than the speed at which the machine moves over the concrete surface.

BRIEF DESCRIPTION OF THE PREFERRED EMBODIMENT

Figure 1:
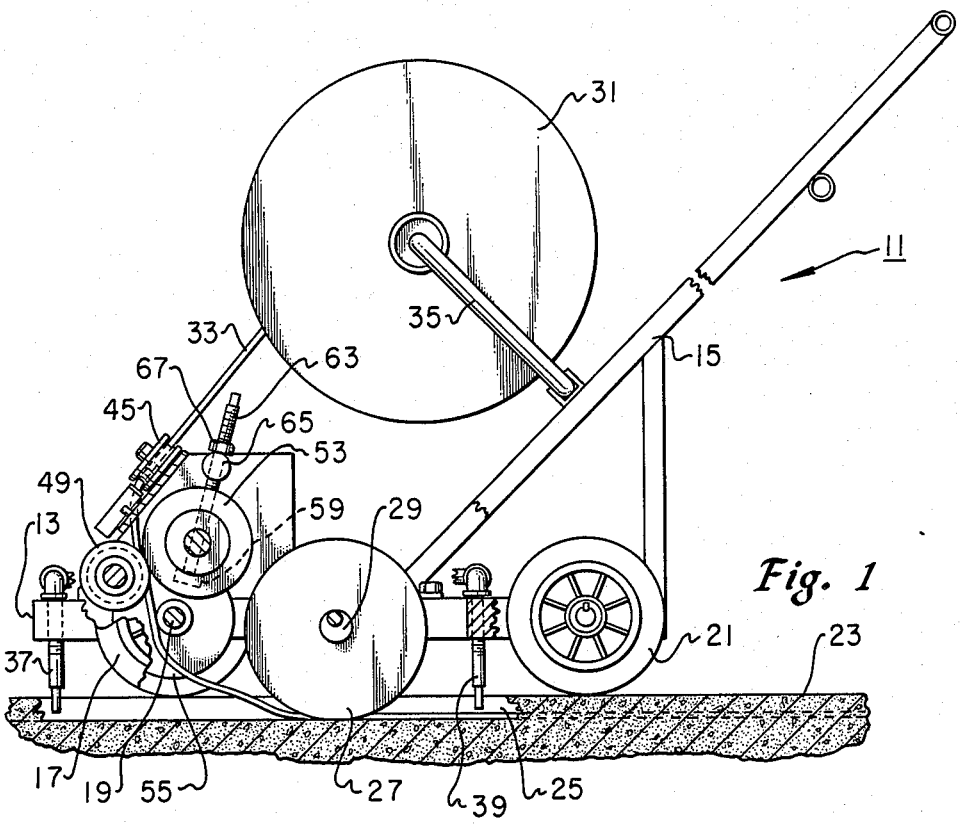
FIG. 1 is a side view, partially in section, of an apparatus constructed in accordance with this invention.

Referring to FIG. 1, the sealing strip insertion machine 11 has a metal frame 13. A handle 15 extends upward and rearward from the frame 13. Frame 13 is supported by front wheels 17 which are spaced apart and located on an axle 19. The frame 13 is also supported by rear wheels 21 located adjacent the rear of the frame 13.

The wheels 17 and 21 roll on the concrete surface 23. The concrete surface 23 has an expansion joint or groove 25 that is formed in it. An insertion disk 27 is rotatably carried by the frame 13 between the front and rear wheels 17, 21. The insertion disk 27 will insert into the groove 25. The insertion disk 27 is freely rotatable, and is mounted on an eccentric shaft 29. The eccentric shaft 29 allows the insertion disk 27 to be moved up and down for various depths. An actuating means (not shown) is connected with the shaft 29 to selectively move the disk 27 up and down by rotating the shaft 29 less than one full turn. An example of a suitable actuating means is shown in my copending patent application filed simultaneously with this application and entitled "Apparatus For Inserting Backing Rod Into Concrete Expansion Joints".

A supply reel 31, wrapped with a quantity of sealing strip 33 is carried by the machine 11. Reel 31 is mounted on an arm 35 which extends upward from the frame 13. Reel 31 is rotatable on the arm 35, which is threaded on the opposite side. A wingnut (not shown) is secured to threads on the arm 35 to retain the reel 31.

Sealing strip 33 is preferably of silicone rubber. It is cylindrical and hollow. Its diameter is the same as the width of the groove 25, so that it is not compressed as it is pushed into the groove 25. The surface of the strip 33 is slightly sticky or tacky, tending to cause the strip 33 to stretch as it is pulled from the reel 31.

A pair of nozzles 37 and 39, one at the front and one at the rear, are connected to a supply of liquid RTV sealant (room temperature vulcanizing). The RTV sealant is a silicone rubber material that cures when exposed to the air. Nozzle 37 lays a bead on each sidewall of groove 25 prior to the sealant strip 33 being pushed into the groove 25. The rear nozzle 39 lays a bead on each sidewall of the groove 25 on top of the sealing strip 33 after it has been inserted into the groove.

Figure 3:
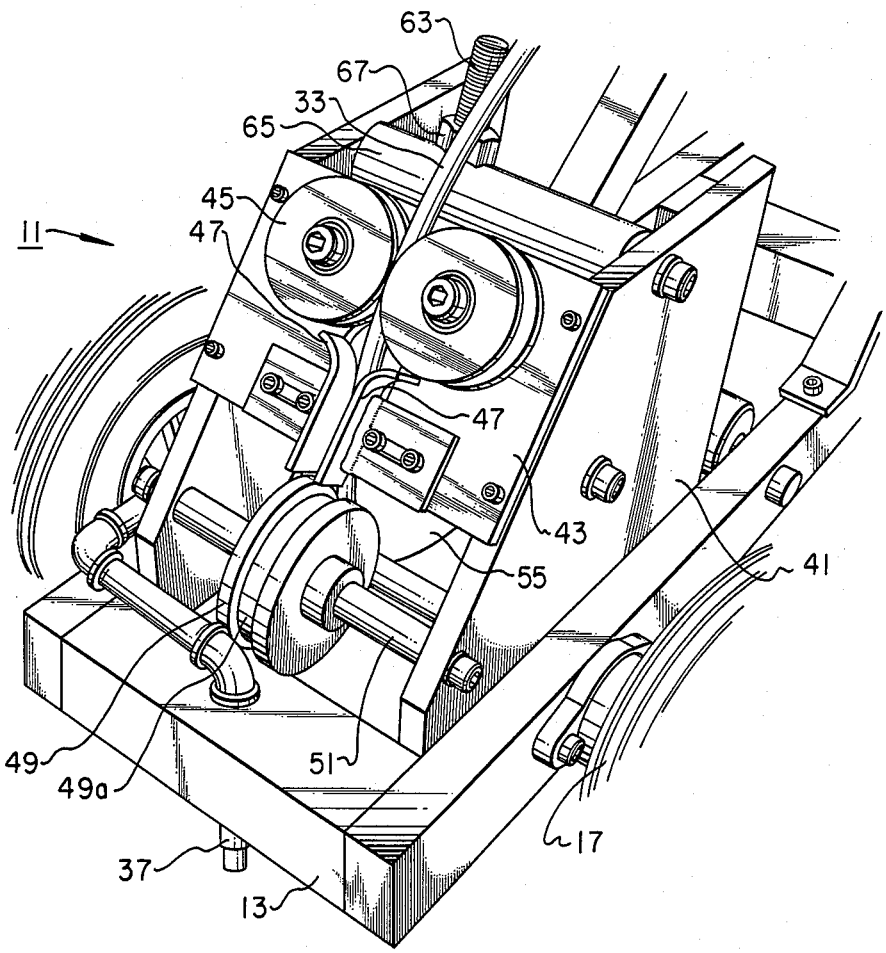
FIG. 3 is a perspective view of a portion of the apparatus of FIG. 1.

Referring now to FIG. 3, the frame 13 includes a pair of side plates 41 that extend upward opposite each other. The side plates 41 are joined in the front with an inclined plate 43. A pair of guide rollers 45 are rotatably mounted to the front plate 43 side by side. The guide rollers 45 are freely rotatable. Each has an axis that is perpendicular to the axle 19 (FIG. 1) between the front wheels 17. The guide rollers 45 receive between them the sealing strip 33 as it is drawn from the reel 31.

A pair of channels 47 are mounted to the front plate 43 forward of the guide rollers 45. Channels 47 are spaced apart from each other for guiding the sealing strip 33 as it is drawn from the reel 31.

A driven pinch roller 49 is located forward of and below the channels 47. Pinch roller 49 has a groove 49*a* on its edge for receiving the sealing strip 33. Pinch roller 49 is mounted to a shaft 51 that is parallel with the axle 19 (FIG. 1) of the front wheels 17. Pinch roller 49 is rotatable.

Figure 2:
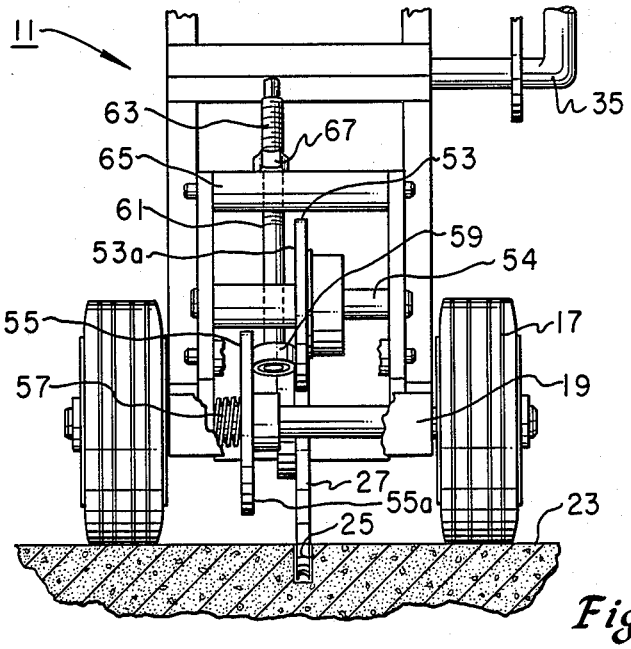
FIG. 2 is a front view of the apparatus of FIG. 1, with some of the components removed to illustrate the invention.

Referring now to FIG. 1, a drive pinch roller 53 is located rearward of the driven pinch roller 49 and rotatably mounted on a shaft 54 (FIG. 2). The drive pinch roller 53 has an edge that is positioned to compress the sealing strip 33 between it and the groove 49*a* of the driven pinch roller 49. The drive pinch roller 53 has a sidewall 53*a*, shown in FIG. 2. In FIG. 2, the front plate 43, guide rollers 45, channels 47, and driven pinch roller 49 are not shown for clarity.

The drive pinch roller 53 has a drive means that rotates the drive pinch roller 53 as the frame 13 is moved. This drive means includes a drive disk 55 which is mounted on the front axle 19. The drive disk 55 has a sidewall 55*a* that faces the sidewall 53*a* of the drive pinch roller 53. This results in a space between them. A key (not shown) between the axle 19 and the drive disk 55 causes the drive disk 55 to rotate with the wheels 17 as the frame 13 is moved along the concrete surface 23. The drive disk 55 is capable of sliding along the axis of axle 19. A coil spring 57 located on the axle 19 pushes the drive disk 55 toward the drive pinch roller 53.

An idler roller 59 is located in the space between the drive disk 55 and the drive pinch roller 53. The idler roller 59 is resilient, and is compressed by the coil spring 57. The idler roller 59 is located perpendicular to the axis of the axle 19. The idler roller 59 engages both sidewalls 53*a* and 55*a* to cause the drive pinch roller 53 to rotate when the drive disk 55 rotates.

Idler roller 59 serves as a linkage means between the drive disk 55 and the drive pinch roller 53 to cause the drive pinch roller 53 to rotate when the drive disk 55 rotates. An adjusting means will adjust the position of contact of the idler roller 59 so as to vary the speed of the rotation. This adjusting means includes a shaft 61 to which the idler roller 59 is rotatably mounted. Shaft 61 extends upward and rearward through shaft 54, terminating in a threaded end 63. The threaded end 63 engages threads in a brace 65 that is rigidly mounted to the side plates 41. A nut 67 engages the threaded end 63 and bears against the brace 65 to lock the shaft 61 in position.

Rotating the shaft 61 raises and lowers the idler roller 59. When the idler roller 59 is raised, it engages a greater diameter portion of the sidewall 55*a*, causing the idler roller 59 to rotate faster. As the idler roller 59 moves upward, it engages a lesser diameter portion of the sidewall 53*a*, which further causes a greater output speed on the pinch roller 53.

In operation, an operator will grasp the handle 15 and push it forward. As the wheels 17 rotate, the drive disk 55 will rotate. The drive disk 55 will rotate the idler roller 59. The idler roller 59 will rotate the drive pinch roller 53. The drive pinch roller 53 cooperates with the driven pinch roller 49 to pull the strip 33 from the reel 31. The tension may be sufficient to cause stretching of the strip 33 between the pinch rollers 49 and 53 and the reel 31.

The speed of rotation of the pinch roller 53 will be selected by experiment so that the strip 33 will be relaxed between the pinch rollers 49 and 53 and the insertion disk 27, as shown in FIG. 1. This speed is selected so that preferably slightly more strip 33 is pulled from the reel 31 than the incremental distance that the frame 13 is travelling during the same time. This slightly higher rate of speed accounts for the stretch in the strip 33. This slightly higher rate of feed from the pinch rollers 49 and 53 results in the strip 33 being completely relaxed and lying on top of the groove 25. The rotational speed is varied by rotating the shaft 61, which moves the idler roller 59 up and down.

As the frame 13 is moved along the concrete 23, the insertion disk 27 will push the strip 33 to the bottom of the groove 25. Liquid sealant will be introduced from the nozzles 37 and 39.

The invention has significant advantages. The pinch rollers, rather than the insertion disk, pull the sealing strip from the reel, preventing the sealing strip from being pushed into the groove while under tension. Adjustability of the drive means for the pinch rollers assures that the strip will be in a relaxed condition between the insertion disk and the pinch rollers. Because the rotation of the speed of the pinch rollers changes automatically in proportion to the speed that the wheels move, readjustment is not needed depending how fast or slow the machine is being moved.

While the invention has been shown in only one of its forms, it should be apparent to those skilled in the art that it is not so limited, but is susceptible to various changes without departing from the scope of the invention.

I claim:

1. An apparatus for inserting a resilient strip into a groove in a concrete surface, comprising in combination:

a frame;

a plurality of wheels mounted to the frame for rolling the frame on the concrete surface;

a supply reel rotatably mounted to the frame, about which a quantity of the strip is adapted to be wound;

an insertion disk rotatably mounted to the frame and adapted to be positioned in the groove for pushing the strip drawn from the reel into the groove;

a pair of pinch rollers rotatably mounted to the frame for tightly receiving the strip between them prior to contact of the strip with the insertion disk;

drive means driven by rotation of the wheels for rotating at least one of the pinch rollers; and adjusting means for varying the drive means to change the speed of the pinch rollers relative to the speed of the wheels, to pull the strip from the reel with the pinch rollers at a speed selected to remove tension in the strip between the pinch rollers and insertion disk.

2. An apparatus for inserting a resilient strip into a groove in a concrete surface, comprising in combination:

a frame;

a plurality of wheels mounted to the frame for rolling the frame on the concrete surface;

a supply reel rotatably mounted to the frame, about which a quantity of the strip is adapted to be wound;

an insertion disk rotatably mounted to the frame and addapted to be positioned in the groove for pushing the strip drawn from the reel into the groove;

a pair of pinch rollers rotatably mounted to the frame for tightly receiving the strip between them prior to contact of the strip with the insertion disk;

drive means driven by rotation of the wheels for rotating at least one of the pinch rollers; and adjusting means for varying the drive means to change the speed of the pinch rollers relative to the speed of the wheels and at a speed selected to pull a greater linear amount of the strip from the reel than the distance the frame moves along the concrete during the same time increment, to pull the strip from the reel with the pinch rollers at a speed selected to remove tension in the strip between the pinch rollers and insertion disk.

3. An apparatus for inserting a resilient strip into a groove in a concrete surface, comprising in combination:

a frame;

a plurality of wheels mounted to the frame for rolling the frame on the concrete surface;

a supply reel rotatably mounted to the frame, about which a quantity of the strip is adapted to be wound;

an insertion disk rotatably mounted to the frame and adapted to be positioned in the groove for pushing the strip drawn from the reel into the groove;

a pair of pinch rollers rotatably mounted to the frame for tightly receiving the strip between them prior to contact of the strip with the insertion disk;

a drive member mounted in engagement with one of the wheels for rotation by the wheel as the frame is moved along the concrete;

linkage means interconnecting the drive member with one of the pinch rollers for rotating the pinch rollers to pull the sealing strip from the reel with the pinch rollers as the frame is moved along the concrete; and adjusting means for varying the rotational speed of the pinch rollers relative to the rotational speed of the wheels, to place the strip in a relaxed condition between the pinch rollers and the insertion disk.

4. The apparatus according to claim 3 wherein the adjusting means varies the rotational speed of the pinch rollers by varying the linkage means.

5. The apparatus according to claim 3 further comprising:

a pair of nozzles, one located forward of the insertion disk and one rearward of insertion disk, for injecting a liquid sealant into the groove.

6. An apparatus for inserting a resilient strip into a groove in a concrete surface, comprising in combination:

a frame;

a pair of spaced apart front wheels mounted on an axle adjacent the front end of the frame;

a pair of spaced apart rear wheels mounted adjacent the rear end of the frame;

a supply reel rotatably mounted to the frame about which a quantity of the strip is adapted to be wound;

an insertion disk rotatably mounted to the frame and adapted to be positioned in the groove for pushing strip drawn from the reel into the groove;

a drive pinch roller and a driven pinch roller rotatably mounted to the frame between the reel and the insertion disk, for receiving the strip between them, the pinch rollers being mounted on shafts which are parallel to the axle of the front wheels, the drive pinch roller having a sidewall;

a drive disk mounted to the axle between the front wheels for rotation with the wheels, and having a sidewall facing the sidewall of the drive pinch roller, defining a space between the sidewalls;

an idler roller mounted to the frame on a shaft that is parallel with the axis of the idler roller and perpendicular to the axle between the front wheels, the idler roller being located in the space between the drive disk and drive pinch roller and engaging each sidewall in rolling contact for transmitting rotation of the drive disk to the drive pinch roller; and adjusting means for raising and lowering the shaft relative to the frame to selectively position the idler roller radially on the drive disk and thus vary the speed of rotation of the drive pinch roller.

7. The apparatus according to claim 6 further comprising bias means for urging the drive disk and drive pinch rollers toward each other to press the idler roller between the drive disk and drive pinch roller.

8. The apparatus according to claim 6 wherein the drive disk is mounted to the axle between the forward wheels for lateral sliding movement toward the drive pinch roller, and wherein the apparatus further comprises:

spring means located on the axle for urging the drive disk laterally toward the drive pinch roller.

9. The apparatus according to claim 6 further comprising a pair of guide rollers rotatably mounted to the frame upward from the pinch rollers for receiving the strip between them, the guide rollers being mounted perpendicular to the pinch rollers.

10. A method of inserting a resilient strip into a groove in a concrete surface, comprising:

mounting a supply roll of the strip to a frame on wheels;

rotatably mounting an insertion disk to the frame to push the strip into the groove;

rotatably mounting a pair of pinch rollers to the frame, and inserting the sealing strip between the pinch rollers;

providing a drive means between the wheels and one of the pinch rollers for causing the pinch rollers to rotate when the wheels rotate;

moving the frame along the concrete surface to cause the drive means to rotate the pinch rollers to pull the strip from the reel with the pinch rollers and place the strip on the groove;

pressing the strip into the groove with the insertion disk; and adjusting the drive means to vary the speed of rotation of the pinch rollers relative to the speed of rotation of the wheels to assure that no tension is located in the strip between the pinch rollers and the insertion disk.

* * * * *